US006491365B2

(12) United States Patent
Sonobe

(10) Patent No.: US 6,491,365 B2
(45) **Date of Patent: *Dec. 10, 2002**

(54) IMAGE FORMING METHOD AND APPARATUS THEREFOR

(75) Inventor: Youichi Sonobe, Kawasaki (JP)

(73) Assignee: Canon Aptex, Mitsukaido (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1 day.

(21) Appl. No.: 09/092,999

(22) Filed: Jun. 8, 1998

(65) Prior Publication Data

US 2002/0113836 A1 Aug. 22, 2002

(30) Foreign Application Priority Data

Jun. 11, 1997 (JP) ..... 9-153456

(51) Int. Cl.[7] ..... B41J 2/165
(52) U.S. Cl. ..... 347/22; 347/29; 347/85
(58) Field of Search ..... 347/33, 29, 30, 347/22, 85, 6, 86, 84

(56) References Cited

U.S. PATENT DOCUMENTS

| | | | | |
|---|---|---|---|---|
| 4,296,418 A | * | 10/1981 | Yamazaki et al. | 347/28 |
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,126,766 A | * | 6/1992 | Terasawa et al. | 347/30 |
| 5,381,169 A | * | 1/1995 | Arai et al. | 347/33 |
| 5,534,897 A | | 7/1996 | Anderson et al. | 347/32 |
| 5,561,448 A | | 10/1996 | Kaneko et al. | |
| 5,570,117 A | | 10/1996 | Karambelas et al. | |
| 5,946,008 A | * | 8/1999 | Nishizawa et al. | 347/30 |

FOREIGN PATENT DOCUMENTS

| | | | |
|---|---|---|---|
| EP | 0 376 309 | 7/1990 | |
| EP | 0 401 026 | 12/1990 | |
| JP | 59-123670 | 7/1984 | |
| JP | 59-138461 | 8/1984 | |
| JP | 01281947 | * 11/1989 | 347/30 |
| JP | 6-143554 | 5/1994 | |

* cited by examiner

*Primary Examiner*—Michael Nghiem
*Assistant Examiner*—Shih-wen Hsieh
(74) *Attorney, Agent, or Firm*—Fitzpatrick, Cella, Harper & Scinto

(57) ABSTRACT

An image forming apparatus prevents foreign matter, such as dust or the like, from being sucked into an ink passage from an ejection opening when a liquid ejection head ejecting a liquid is elevated from an image forming position to a recovery process position located above the image forming position. The image forming apparatus includes a liquid supply passage connected to the liquid ejection head which is provided with ejection openings for ejecting liquid, a liquid supply device for supplying liquid to the liquid ejection head via the liquid supply passage, a recovery process device for recovering the ejecting condition of liquid from the liquid ejection head, a head moving device for moving the liquid ejection head between the recovery process position for performing recovery process of the liquid ejection head by the recovery process device and an image forming position for forming an image on the printing medium by the liquid ejection head, and a closing device for closing the liquid supply passage during movement of the liquid ejection head into the recovery process position by the head moving device.

12 Claims, 11 Drawing Sheets

IMAGE FORMING METHOD AND APPARATUS THEREFOR

This application is based on patent application Ser. No. 09/153,456 filed Jun. 11, 1997 in Japan, the content of which is incorporated hereinto by reference.

BACKGROUND OF THE INVENTION

1. Field of the Invention

The present invention relates to an image forming method and an apparatus for forming an image on a printing medium by ejecting a liquid from a liquid ejecting head. More particularly, the invention is suitable for application to an ink-jet printer mounting a full-line type ink-jet head, in which a plurality of ejection openings for liquid are arranged over the entire width of an image forming region of the printing medium.

2. Description of the Related Art

An ink-jet printer for forming a desired image by ejecting an ink droplet onto a paper, a cloth, a resin, a metal and the like, features non-contact recording with respect to a printing medium and thus is superior in low noise, high printing speed, capability of high resolution printing, easiness of color printing, and capability of down-sizing of the overall apparatus.

As one of such ink-jet printers, there has been known a printer shown in FIG. 10, in which a plurality of elongated so-called full-line type ink-jet heads, each having a plurality of ejection openings arrayed over the entire width of an image forming region of a printing medium, are arranged in a feeding direction of the printing medium.

Namely, the printer includes four ink cartridges 33Y, 33M, 33C, and 33B respectively storing a yellow ink, a magenta ink, a cyan ink, and a black ink (hereinafter referred to as ink cartridge 33) and four ink-jet heads 21Y, 21M, 21C and 21B (hereinafter referred to as ink-jet head 22) connected to respective ink cartridges 33 via ink supply tubes 32, respectively.

The ink-jet heads 21, each of which is switched power supply between ON and OFF for respective ones of not shown electrothermal transducers by a head driver 61 connected to a control unit 60, are arranged with a predetermined interval along a feeding direction of an endless feeding belt 62 so as to face a platen 63 via the feeding belt 62. By head moving means 64 for recovery process, which is controlled by the control unit 60, the ink-jet heads 21 are moved up and down with respect to the platen 63. On the side portion of each ink-jet head 21, capping members 22, for performing recovery process of the ink-jet heads 21 by performing preliminary ejection of old inks within not shown ink passages provided within the ink-jet heads 21 from the ejection openings in advance of printing operation with respect to a printing paper 65, are arranged in a condition shifted by one-half pitch with respect to an arrangement interval of the ink-jet heads 21. By moving means 66, which is controlled by the control unit 60, the capping members 22 are moved to positions immediately below the ink-jet heads 21 at recovery process positions so as to receive waste inks ejected from the ejection openings.

The feeding belt 62 feeding the printing paper 65 is wound around a driving roller 68 connected to a belt driving motor 67. The driving direction of the feeding belt 62 is switched by a motor driver 69 connected to the control unit 60. On the upstream side of the feeding belt 62, an electrostatic charger 70 is provided for electrostaticly charging the feeding belt 62 for adhering the printing paper 65 on the feeding belt 62. The electrostatic charger 70 is switched ON and OFF by a driver 71 connected to the control unit 60. To a pair of paper feeding rollers 72 for supplying the printing paper 65 on the feeding belt 62, a paper feeding motor 73, for rotatingly driving the pair of paper feeding rollers 72, is connected. The operation of paper feeding motor 73 is switched by a motor driver 74 connected to the control unit 60.

Accordingly, in advance of the printing operation for the printing paper 65, the ink-jet heads 21 are elevated to the recovery process position away from the platen 63. Then, the capping member 22 is moved immediately below the ink-jet heads 21. Then, after the recovery operation for the ink-jet heads 21, the capping member 22 is returned to an initial position. Also, the ink-jet heads 21 are moved toward the platen up to the image forming position. Then, the electrostatic charger 70 is actuated while the feeding belt 62 is driven. Also, the printing paper 65 is mounted on the feeding belt 62 by the paper feeding roller 72, and a desired color image is formed on the printing paper 65 by the ink-jet heads 21.

In the full-line type ink-jet printer shown in FIG. 10, the ink-jet heads 21 are located on the upper side of the ink cartridges 33. A problem of causing leakage of the ink through the ejection openings of the ink-jet heads 21 due to a liquid pressure of the ink stored in the cartridges 33 can be successfully prevented.

Because of the constructions set forth above, when the ink-jet heads 21 are elevated from the image forming position to the recovery process position, as illustrated in a sectional structure of the lower end portion of the ink-jet heads 21 in FIG. 11, an ink surface (ink meniscus) M of the ejection openings 40 is located at a position shown by a two dotted line at the image forming position, namely at an ejection opening surface 44 where the ejection openings 40 are formed, and whereas, at the recovery process position above the image forming position, a waterhead difference between the ink surface M and the ink cartridge 33 becomes large to cause recession of the ink surface M into the ink passage 58, as shown by the solid line.

As a result, foreign matter W, such as dust and the like deposited in the vicinity of the ejection openings 40 can be sucked into the ink passage 58 to be held within the ink passage 58 even if the recovery process is performed. In such case, ejection failure can result to prevent formation of a good quality image.

Such drawback may be caused not only in the ink but also in treatment liquid for adjusting printing ability of the ink on and/or in the printing medium.

SUMMARY OF THE INVENTION

An object of the present invention is to provide an image forming method which can successfully prevent the drawback of sucking foreign matter, such as dust or the like from the ejection openings into ink passages even when a liquid ejection head ejecting a liquid is elevated from an image forming position to a recovery process position.

Another object of the present invention is to provide an image forming apparatus which can implement the image forming method set forth above.

The first aspect of the present invention is an image forming method forming an image on a printing medium in an image forming position utilizing a liquid ejection head for forming the image on the printing medium by ejecting liquid in the image forming position, comprising:

a step of performing a recovery process at a recovery process position set on an upper side of the image forming position for recovering ejecting condition of liquid from the liquid ejecting head; and a step of closing a liquid supply passage for supplying liquid to the liquid ejection head during movement of the liquid ejection head from the image forming position to the recovery process position.

The second aspect of the present invention is an apparatus for forming an image on a printing medium utilizing a liquid ejection head provided with an ejection opening for ejecting liquid, comprising:

a liquid supply passage connected to the liquid ejection head;

recovery process means for recovering ejecting condition of liquid from the liquid ejection head;

head moving means for moving the liquid ejection head between the recovery process position for performing recovery process of the liquid ejection head by the recovery process means and an image forming position for forming an image on the printing medium by the liquid ejection head; and closing means for closing the liquid supply passage during movement of the liquid ejection head at least to the recovery process position by the head moving means.

According to the present invention, when the image is formed on the printing medium, the liquid ejection head is moved into the image forming position by the head moving means to form the image on the printing medium using the liquid ejection head at the image forming position.

When recovery process of the liquid ejection head is performed, the liquid supply passage is closed by operating the closing means to restrict flow of liquid between the ejection opening of the liquid ejection head and the liquid supply passage. At this condition, after moving the liquid ejection head from the image forming position to the recovery process position by the head moving means, the closure means is again operated to open the liquid supply passage, and recovery process of the liquid ejection head is performed by the recovery process means at the recovery process position.

The liquid ejection head on which the recovery process has been effected is again returned to the image forming position by the head moving means and image formation on the printing medium is performed.

According to the present invention, when the recovery process is performed in order to recover ejecting condition of liquid from the liquid ejection head at the recovery process position set on the upper side of the image forming position, since the liquid supply passage for supplying liquid to the liquid ejection head is closed during movement of the liquid ejection head from the image forming position to the recovery process position, even when the liquid ejection head for ejecting liquid is elevated from the image forming position to the recovery process position, a problem of suction of foreign matter, such as dust or the like into the ink passage from the ejection opening can be successfully prevented.

In the image forming method by the first aspect of the present invention, the recovery process position may include a capping position for covering an ejection opening surface provided with an ejection opening of the liquid ejection head for ejecting liquid, and a wiping position set on an upper side of the capping position for wiping the ejection opening surface.

The recovery process may include at least one of steps of performing preliminary ejection of liquid from the ejection opening of the liquid ejection head at the capping position, expelling liquid from the ejection opening of the liquid ejection head by pressurizing the liquid supply passage, and sucking liquid from the ejection opening of the liquid ejection head.

Liquid may be ink or treatment liquid for adjusting printing ability of the ink on and/or in the printing medium.

In the image forming apparatus by the second aspect of the present invention, the recovery process position may include a capping position and a wiping position located above the capping position, the recovery process means having a capping member for covering the ejection opening surface provided with an ejecting opening of the liquid ejection head ejecting liquid at the capping position and a wiping member for wiping the ejection opening surface at the wiping position. The recovery process means may preliminarily eject liquid from the ejection opening of the liquid ejection head at the capping position, expelling liquid from the ejection opening of the liquid ejection head by actuating the liquid supply means or sucking liquid from the ejection opening of the liquid ejection head via the capping member.

The liquid ejection head may have an ejection energy generating portion for ejecting liquid from the ejection opening. In this case, the ejection energy generating portion may have an electrothermal transducer for generating thermal energy.

The ejection openings may be provided for the liquid ejection head and may be arranged over the entire width of a printing region of the printing medium.

The above and other objects, effects, features and advantages of the present invention will become more apparent from the following description of embodiments thereof taken in conjunction with the accompanying drawings.

DESCRIPTION OF THE PREFERRED EMBODIMENTS

It should be appreciated that while an image forming apparatus according to the present invention will be described in terms of an embodiment, in which a full-line type ink-jet head is applied to a card printer with reference to FIGS. 1 to 9, the present invention is not limited to the card printer but can be applicable to any image forming method and/or an image forming apparatus having the similar problem.

Figure 1:
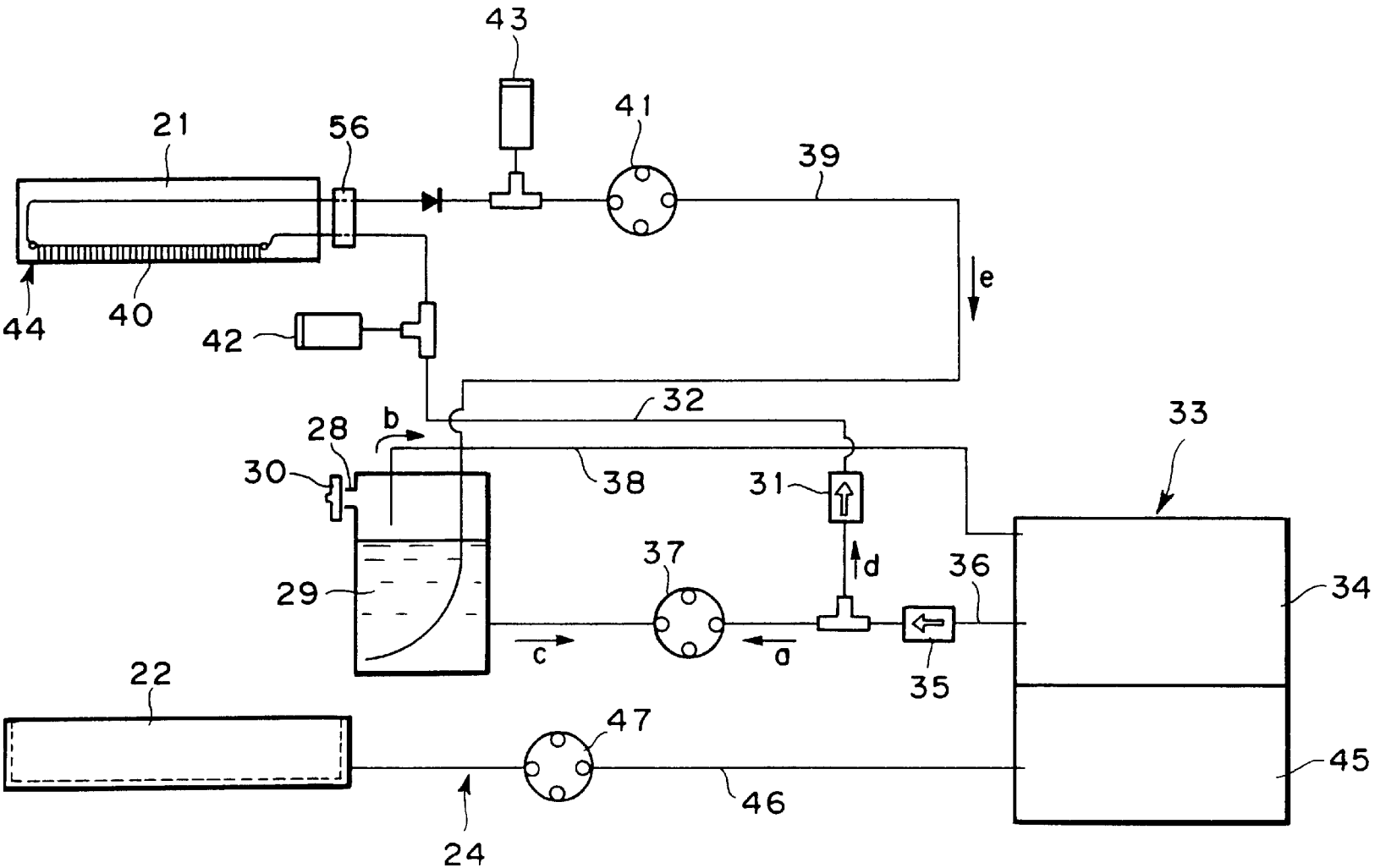
FIG. 1 is a conceptual illustration showing a principle of an ink supply system of a preferred embodiment shown in FIG. 2.
Figure 2:
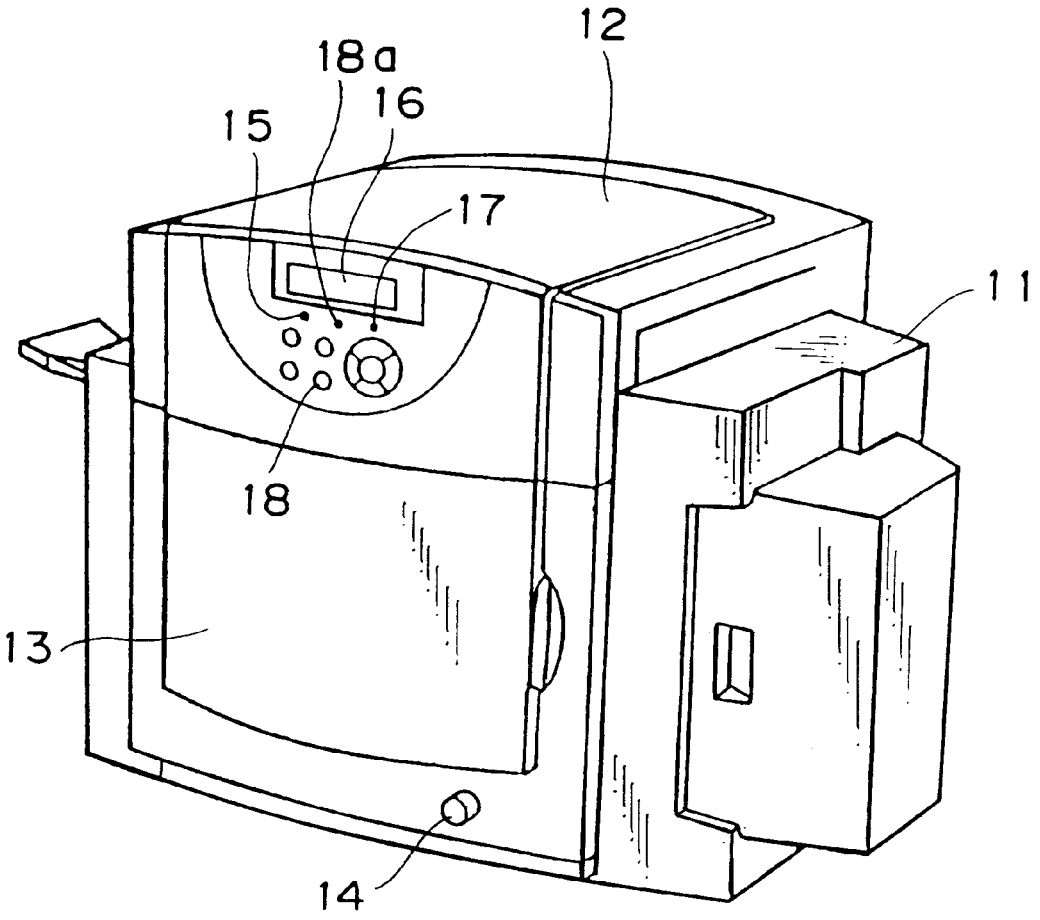
FIG. 2 is a perspective view showing one embodiment, in which an image forming apparatus according to the present invention is applied to a card printer.

An external appearance of the preferred embodiment is shown in FIG. 2. The reference numeral 11 denotes a feeder cover storing cut-sheet 20 as a printing medium, 12 denotes an upper cover for storing a head unit and opening and closing a feeding portion for the cut-sheet 20, and 13 denotes a front cover for loading and unloading ink cartridges 33 (see FIGS. 1 and 5) storing respective colors of inks. The reference numeral 14 denotes a power switch of the card printer, 15 denotes a ready lamp which is lighted when the card printer can be used, 16 denotes a liquid crystal panel for displaying conditions of the card printer, such as an error message and the like, 17 denotes an error lamp which is lighted when an abnormality is caused in the card printer, 18 denotes an on-line lamp which is lighted when the card printer is in on-line condition with a not shown host system, and 18*a* is a data lamp which is blinking when printing data is stored in a not shown memory in the card printer.

Figure 3:
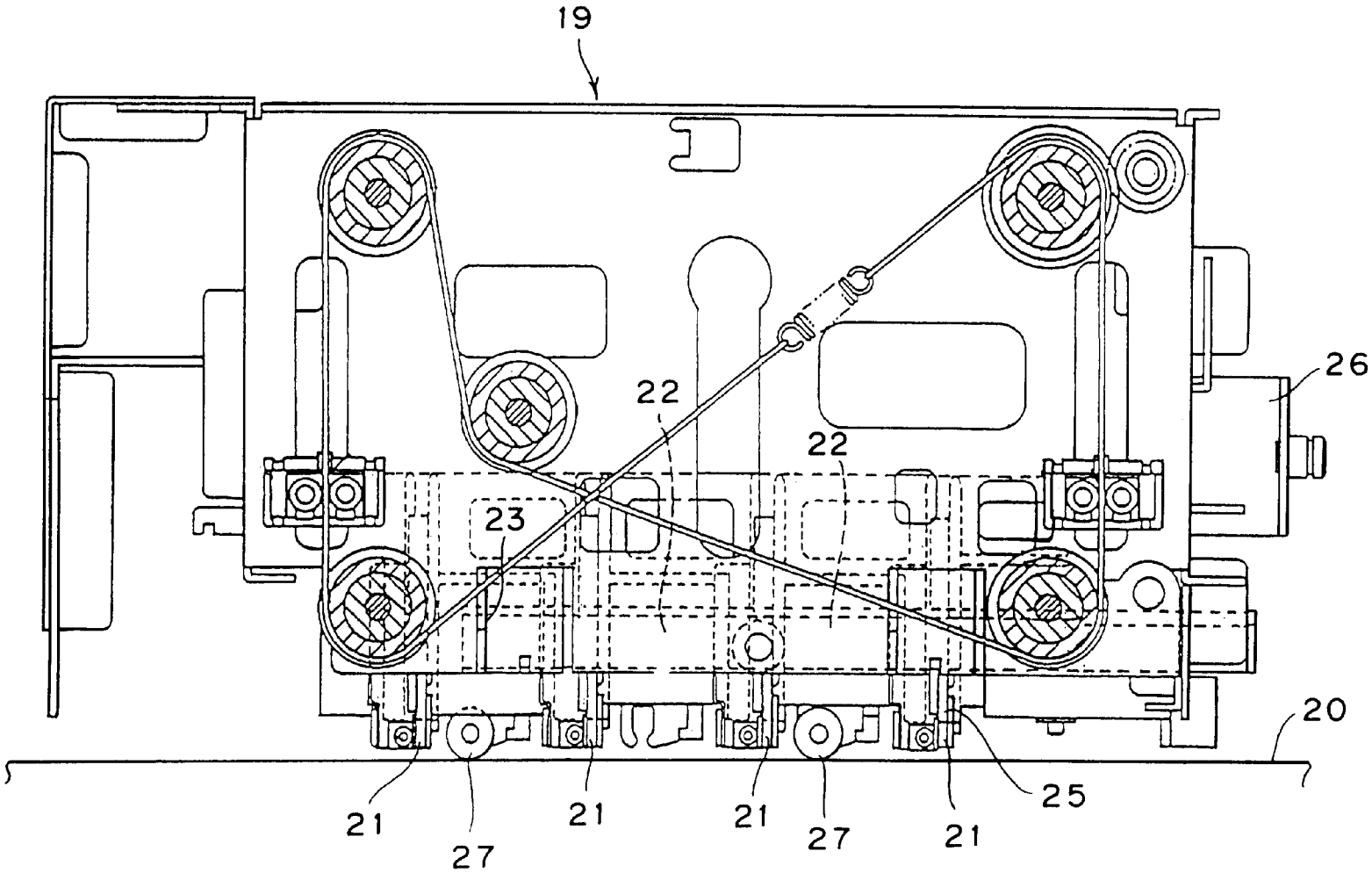
FIG. 3 is a side elevation of a head unit in the embodiment of FIG. 2.
Figure 4:
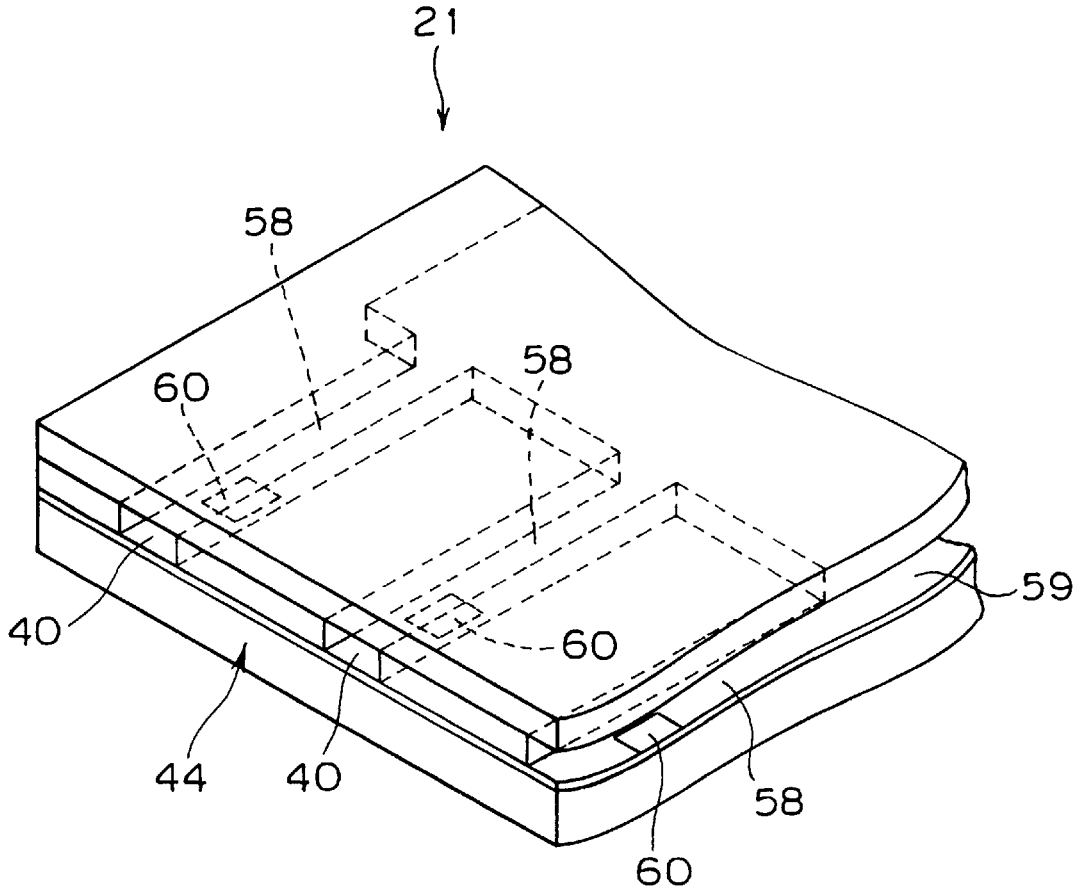
FIG. 4 is a partly extracted and enlarged sectional perspective view of an ink-jet head in the embodiment of FIG. 2.

A shape of the side surface of the head unit in the shown embodiment is shown in FIG. 3 and the inner structure of an ink-jet head in the head unit is shown in FIG. 4. Namely, a head unit 19 includes a plurality of ink-jet heads 21 with respectively arranged ejection openings 40 (see FIG. 1) over the entire width of an image forming region in a width direction perpendicular to a feeding direction (left and right direction in FIG. 3) of the cut-sheet 20, in order to form an image on the cut-sheet 20 placed on the not shown platen. Each of these ink-jet heads 21, a part of which is illustrated in extracted, enlarged and partially cut-out form in FIG. 4, has an electrothermal transducer 60, generating thermal energy for causing film boiling in the ink as an energy to be utilized for ejecting the ink, in an intermediate position of each individual ink passage 58 for communicating between each ejection opening 40 and a common liquid chamber 59.

The head unit 19 has the capping member 22 for receiving the ink ejected from the ejection openings 40 of each ink-jet head 21 and preventing the ink from drying in the vicinity of the ejection opening 40 and a recovering unit 24 (see FIG. 1) having a wiping blade 23 for removing residual ink and the like on the ejection opening surface 44 (see FIG. 1), into which the ejection openings 40 open, by wiping.

Also, the head unit 19 includes a driving unit which vertically moves upward a head holder unit 25 supporting each ink-jet head 21 from the image forming position opposing the cut-sheet 20 to the recovery process position and also horizontally moves the recovering unit 24 along the feeding direction of the cut-sheet 20 a predetermined distance, a cooling unit 26 for cooling the ink-jet head 21, and so on. In the shown embodiment, the recovery process position includes a capping position, in which the ejection opening surface 44 of the ink-jet head 21 is covered with the capping member 22 and a wiping position located on the upper side of the capping position, in which the ejection opening surface 44 of the ink-jet head 21 is wiped by the wiping blade 23. In the capping position, the preliminary ejection by the ink-jet head 21 and discharging of the ink through the ejection opening 40 of the ink-jet head 21 by an ink circulation pump 41 (see FIG. 1), which will be explained later, are performed.

In the lower portion of the head unit 19, spurs 27 for feeding the cut-sheet 20 are provided on both sides of each ink-jet head 21.

Figure 5:
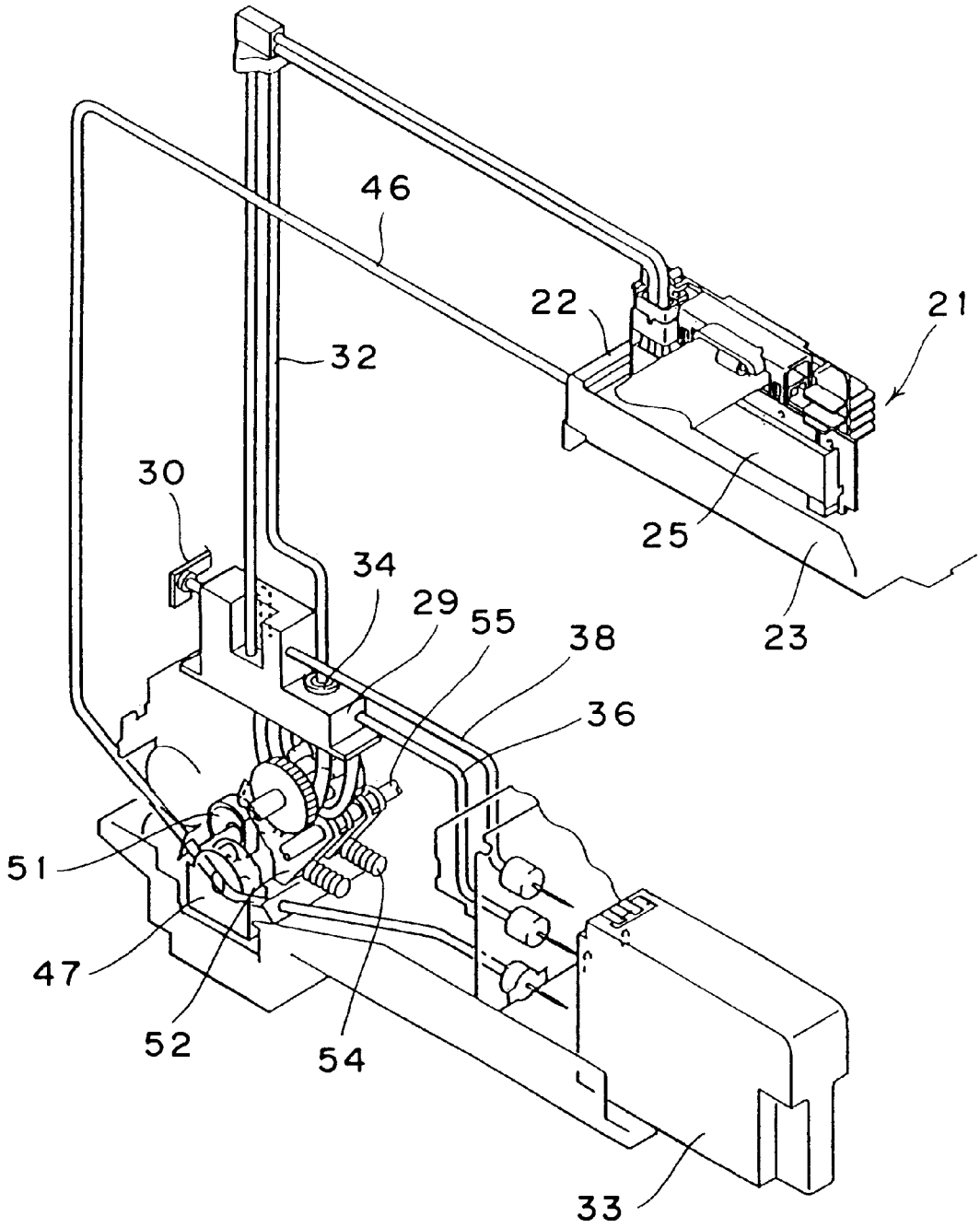
FIG. 5 is a perspective view showing a main portion of the ink supply system in the embodiment of FIG. 2.
Figure 10:
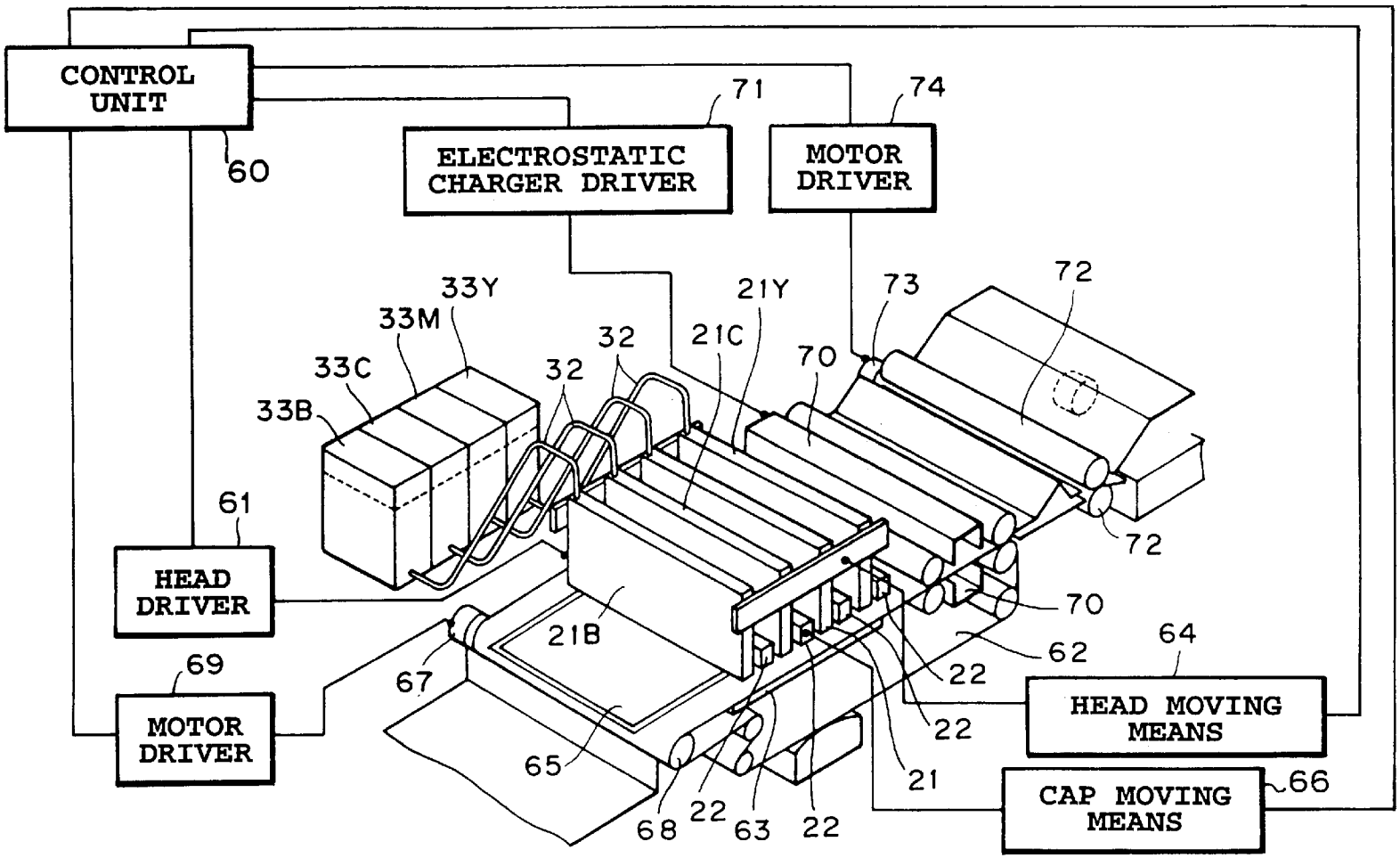
FIG. 10 is conceptual illustration showing a general construction of a full-line type ink-jet printer, to which the present invention is directed.

While the basic construction of a printing apparatus per se to be housed within a housing of the card printer is substantially the same as that shown in FIG. 10, a construction of the major portion is shown in FIG. 1 and a concept of an ink supply system thereof is illustrated in FIG. 5. Namely, the shown embodiment of the card printer includes a sub-tank 29 temporarily storing the ink to be supplied to the ink-jet head 21 and having an atmosphere communication aperture 28, a communication opening closing valve 30 for opening or closing the atmosphere communication opening 28 of the sub-tank 29, an ink supply tube 32 connecting the ink-jet head 21 and the sub-tank 29 and having a check valve 31 at the intermediate position thereof, a branched pipe 36 connected to the ink supply tube 32 at the position between the sub-tank 29 and the check valve 31 at one end and connected to a supply ink storage portion 34 of the ink cartridge 33 storing the ink at the other end, an ink supply pump 37 attached to the ink supply tube 32 at the position between a joining position of the branched tube 36 and the ink supply tube 32, which ink supply pump 37 can selectively supply the ink within the supply ink storage portion 34 of the ink cartridge 33 to the sub-tank 29 or the ink in the sub-tank 29 to the ink-jet head 21, an ink return tube 38 connected to the sub-tank 29 and the supply ink storage portion 34 of the ink cartridge 33 at both ends and adapted to return excess ink exceeding a predetermined amount in the sub-tank 29 to the supply ink storage portion 34 of the ink cartridge 33, an ink circulating tube 39 connected to the ink-jet head 21 and the sub-tank 29 at both ends and adapted to circulate the ink within the sub-tank 29 through the ink-jet head 21, and an ink circulating pump 41 provided in the ink circulating tube 39 for flowing out the ink within the sub-tank 29 from the ejection opening 40 of the ink-jet head 21 or for returning the ink supplied from the ink supply tube 32 to the ink-jet head 21 to the sub-tank 29 via the ink circulating tube 39 again.

The check valve 31 prevents backward flow the ink in the ink supply tube 32 from the ink-jet head 21 side to the ink supply tube 32. Also, the check valve 35 serves for preventing backward flow of the ink within the ink supply tube 32 from the ink supply pump 37 side to the supply ink storage portion 34 of the ink cartridge 33. Also, in the shown embodiment, in the ink supply tube 32 between the ink-jet head 21 and the check valve 31 and the ink circulating tube 39 between the ink-jet head 21 and the ink circulating pump 41, buffer tanks 42 and 43 for suppressing pulsation of the ink supply pump 37 and the ink circulating pump 41 are provided.

The capping member 22 covering the ejection opening surface 44, into which the ejection openings 40 of the ink-jet head 21 open, and a waste ink storage portion 45 of the ink cartridge 33 are connected via a waste ink collection tube 46. In the waste ink collection tube 46, a waste ink collection pump 47 pumps waste ink received in the capping member 22 to the waste ink storage portion 45 of the ink cartridge 33 under pressure.

Figure 6:
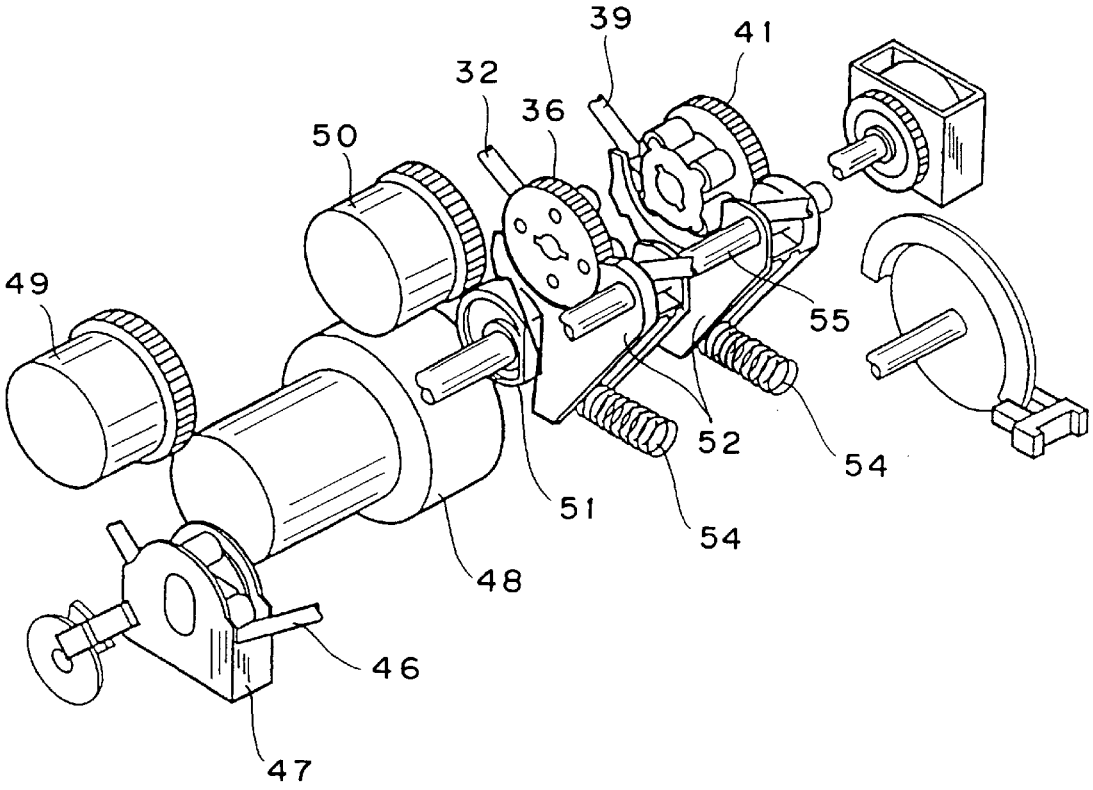
FIG. 6 is a perspective view showing a pump driving system in the embodiment of FIG. 2.
Figure 7:
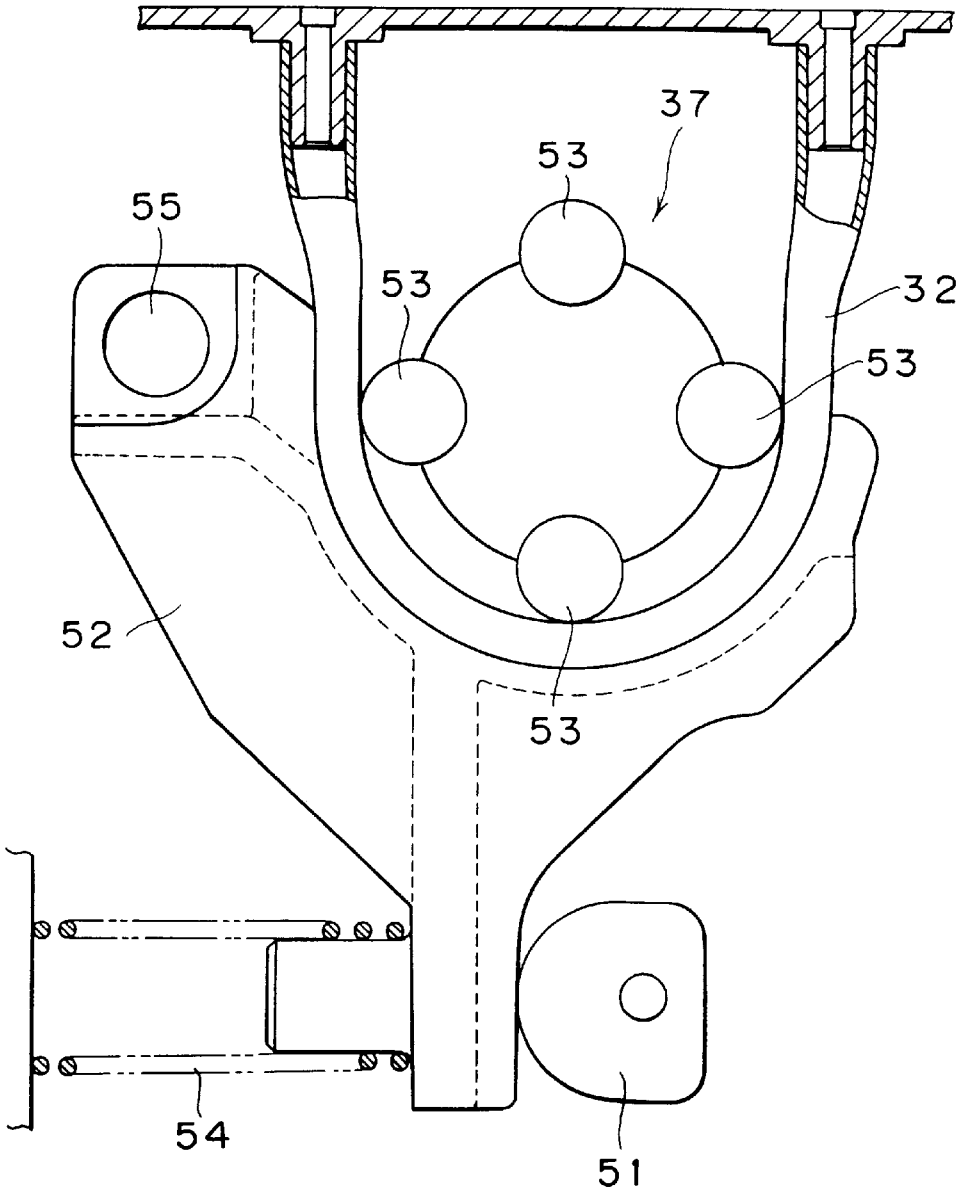
FIG. 7 is a front elevation showing a general construction of an ink supplying pump in the embodiment of FIG. 2.

As all of the foregoing pumps 37, 41 and 47, tube pumps are used. An external appearance of a pump unit employed in the shown embodiment is shown in FIG. 6. A construction of the ink supply pump 37 is shown in FIG. 7. However, the ink circulating pump 41 and the ink supply pump 37 have completely identical construction. Namely, these pumps 37, 41 and 47 are driven by a direct current motor 48. The ink supply pump 37 and the ink circulating pump 41 are controlled via clutches 49 and 50, respectively. A pressure releasing cam 51 is driven by a not shown cam clutch and switches the ink supply pump 37 and the ink circulating pump 41 between active state and idling state via a pump retainer 52.

Namely, even when the ink supply pump 37 is driven under a condition shown in FIG. 7, a roller 53 of the ink supply pump 37 merely contacts with the ink supply tube 32 and cannot crush the latter. In such cases, the roller 53 is merely driven in idling state. From this condition, by turning the pressure releasing cam 51 180°, the pump retainer 52 is pivoted in counterclockwise direction about a pivot shaft 55 by a spring force of a compression spring 54. Then, a gap between the roller 53 of the ink supply pump 37 and the pump retainer 52 is narrowed to crush the ink supply tube 32 by the roller 53 of the ink supply pump 37. By actuating the ink supply pump 37 under this condition, a pumping function is caused. When the clutches 49 and 50 are switched, the ink supply pump 37 and the ink circulating pump 41 are not actuated and the ink supply tube 31 and the ink circulating tube 39 are held in closed condition.

The waste ink collection pump 47 is coupled with a direct current motor 48 via a not shown one-way clutch.

Accordingly, the ink stored in the supply ink storage portion 34 of the ink cartridge 33 flows in a direction shown by an arrow a in the drawing, within the ink supply tube 32 from the branching tube 36 via the check valve 31 by revolution of the supply pump 37 in the counterclockwise direction, and is stored in the sub-tank 29. When the ink accumulated in the sub-tank 29 reaches a predetermined amount, the ink flows in a direction of arrow b from the ink return tube 38 to be returned to the supply ink storage portion 34 of the ink cartridge 33. At this time, the communication opening closing valve 30 of the sub-tank 29 is placed in a condition closing the atmosphere communication opening 28.

By clockwise revolution of the ink supply pump 37 and the ink circulating pump 41, the ink accumulated in the sub-tank 29 flows in directions of arrows c and d within the ink supply tube 32 to be supplied to the ink-jet head 21 via the buffer tank 42 and a connecting portion 56 through the check valve 31. Then, the ink circulated within the ink-jet head 21 flows in a direction of arrow e within the ink circulating tube 39 from the connecting portion 56 via a buffer tank 43, and again is returned to the sub-tank 29. At this time, the communication opening closing valve 30 of the sub-tank 29 is held in the opened condition.

Next, the recovery process by the recovering unit 24 will be explained. The recovery process of the shown embodiment includes a normal cleaning process to be performed upon initiation of operation of the card printer, a second cleaning process to be performed in place of the normal cleaning only when the normal cleaning process is performed for a predetermined time, a recovery process to be performed immediately before formation of the image and a recovery process performed immediately after formation of the image.

When the normal cleaning process is performed, in the capping position of the recovery process position, namely the waiting position, the pressure releasing cam 51 is switched into the engaging position by rotation of 180° from the release position shown in FIG. 7. Then, when the ink supply pump 37 is driven in the clockwise direction while disconnecting only clutch 50, the ink circulating tube 39 is placed in a condition closed by the ink circulating pump 41 to cause the ink within the sub-tank 29 to flow in the direction shown by arrows c and d to be discharged to an ink absorbing element 57 of the capping member 22 from the ejection openings 40 of the ink-jet head 21. At this time, the communication opening closing valve 30 of the sub-tank 29 is placed in the opened condition.

Thereafter, the ink-jet head 21 is elevated to the wiping position to remove the ink droplets deposited on the ejection opening surface 44 by the wiping blade 23 (see FIG. 3). Then, the ink-jet head 21 is lowered again to the capping position. The pressure releasing cam 51 is returned to the release position shown in FIG. 7 to perform preliminary ejection, namely to eject the predetermined amount of ink droplets to the ink absorbing element 57 of the capping member 22 from the ejection openings 40 of the ink-jet head 21 in the same operation as that upon formation of the image.

The waste ink thus received within the capping member 22 is collected in the waste ink storage portion 45 of the ink cartridge 33 by the waste ink collection pump 47.

When the normal cleaning process is performed for a predetermined number of times, it is deemed that bubbles are admixed in the tubing system, and the more elaborate second cleaning process is performed in the following manner. Namely, in the capping position of the recovery process position, the pressure releasing cam 51 is switched to the engaging position to engage both of the clutches 49 and 50 to drive the ink supply pump 37 and the ink circulating pump 41 in the clockwise direction. Therefore, the ink is circulated in the ink-jet head 21 and returned to the sub-tank 29. In this case, while small in amount, the ink from the ejection openings 40 is discharged to the ink absorbing element 57 of the capping member 22. However, by the buffer tanks 42 and 43, pulsation of the ink supply pump 37 and the ink circulating pump 41 are suppressed to permit smooth circulation of the ink.

Furthermore, similar to the normal cleaning process, the ink circulating pump 41 is stopped by disengaging the clutch 50 to discharge the ink from the ejection opening 40 by revolution of only ink supply pump 37 to the ink absorbing element 57 of the capping member 22. At this time, the communication opening closing valve 30 of the sub-tank 29 is held in the open position.

Thereafter, the ink-jet head 21 is elevated to the wiping position to remove the ink droplets deposited on the ejection opening surface 44 by the wiping blade 23. Then, the ink-jet head 21 is lowered again to the capping position, and the pressure releasing cam 51 is returned to the release position shown in FIG. 7 to perform preliminary ejection. By performing preliminary ejection, the ink ejected form the ejection opening 40 is received by the capping member 22 of the recovering unit 24 and is collected in the waste ink storage portion 45 of the ink cartridge 33 by the waste ink collection pump 47.

In the recovery process performed immediately before formation of image, preliminary ejection is performed by the ink-jet head 21, while maintaining the pressure releasing cam 51 in the release position, at the capping position to receive the ink ejected from the ejection openings 40 by the capping member 22 of the recovering unit 24 to be collected in the waste ink storage portion 45 of the ink cartridge 33 by the waste ink collection pump 47. At this time, the communication opening closing valve 30 of the sub-tank 29 is held in the open condition.

Thereafter, the ink-jet head 21 is lowered to the image forming position to perform the image forming process for the cut-sheet 20.

In the recovery process performed immediately after the image forming operation, the pressure releasing cam 51 is switched from the release position to the engaging position at the image forming position to elevate the ink-jet head 21 to the wiping position, with the ink supply tube 32 and the ink circulating tube 39 being in closed condition, to wipe the ejection opening surface 44 by the wiping blade 23 to remove the ink droplets deposited on the ejection opening surface 44. Thereafter, the ink-jet head 21 is lowered to the capping position to cover the ejection opening surface 44 by the capping member 22 and the pressure releasing cam 51 is switched to the release position to perform the preliminary ejection. In the shown embodiment, the foregoing wiping operation and the preliminary ejection are repeated twice, respectively.

Figure 8:
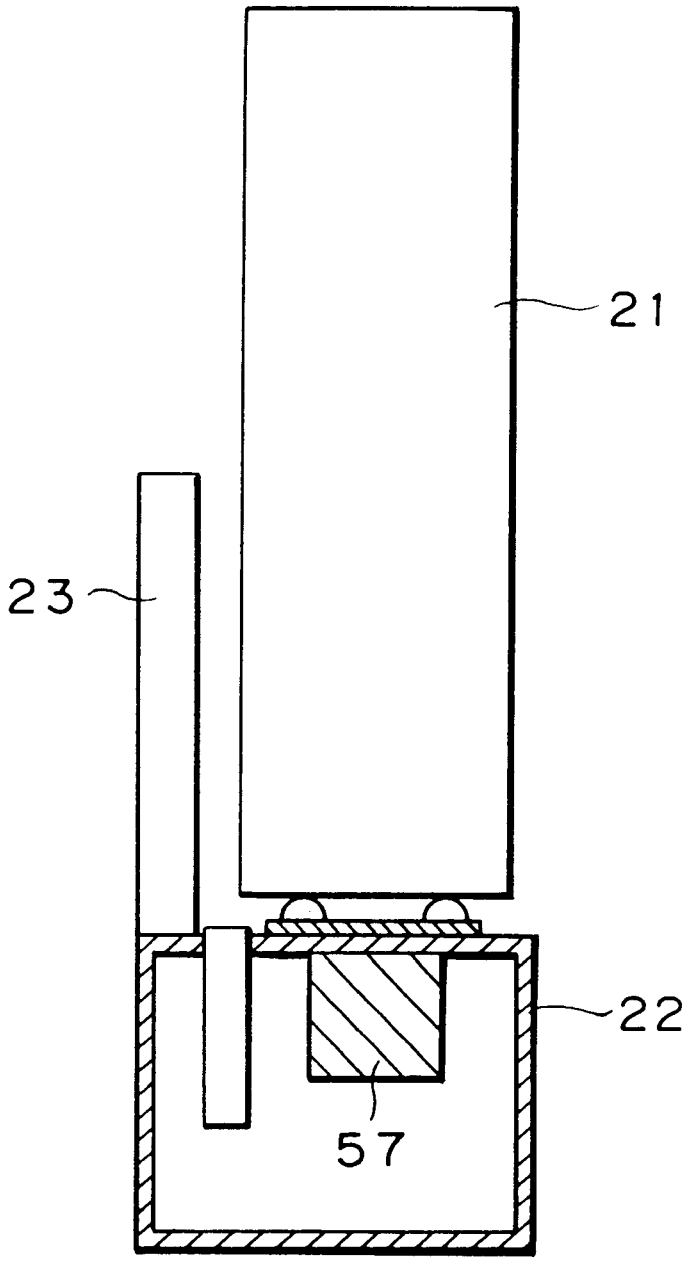
FIG. 8 is a conceptual illustration showing a relative position of the ink-jet head and a capping member in a capping position.
Figure 9:
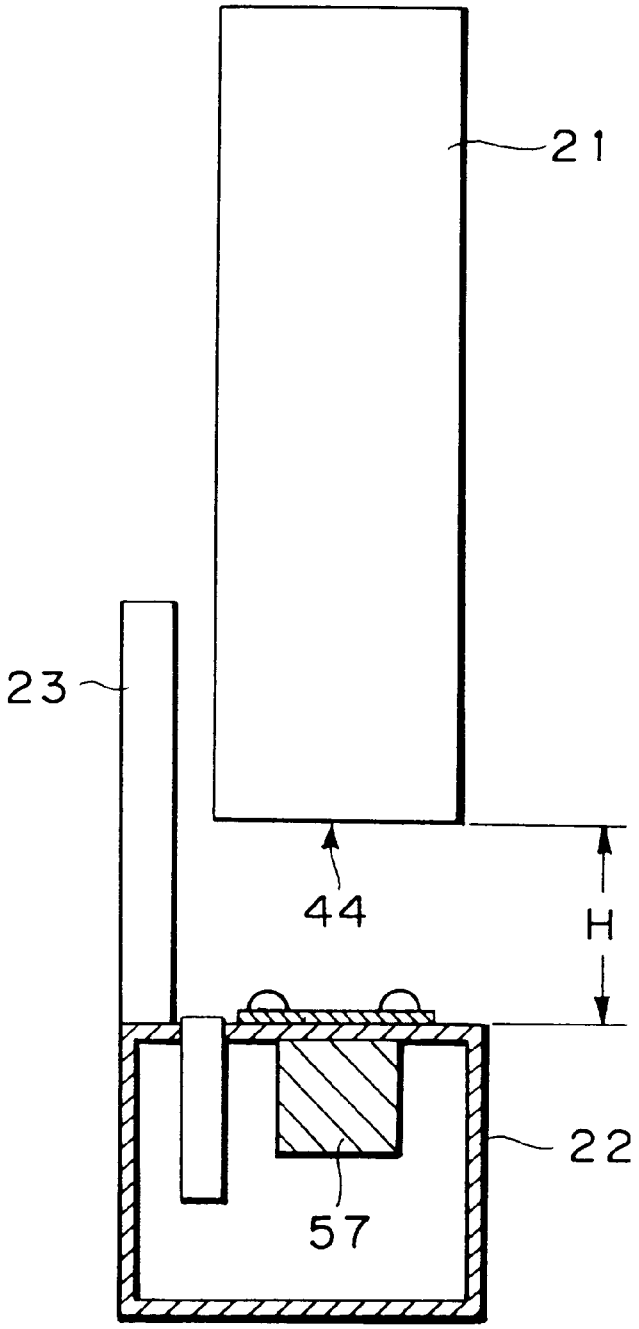
FIG. 9 is a conceptual illustration showing a condition where the ink-jet head is elevated from the capping position to a wiping position.
Figure 11:
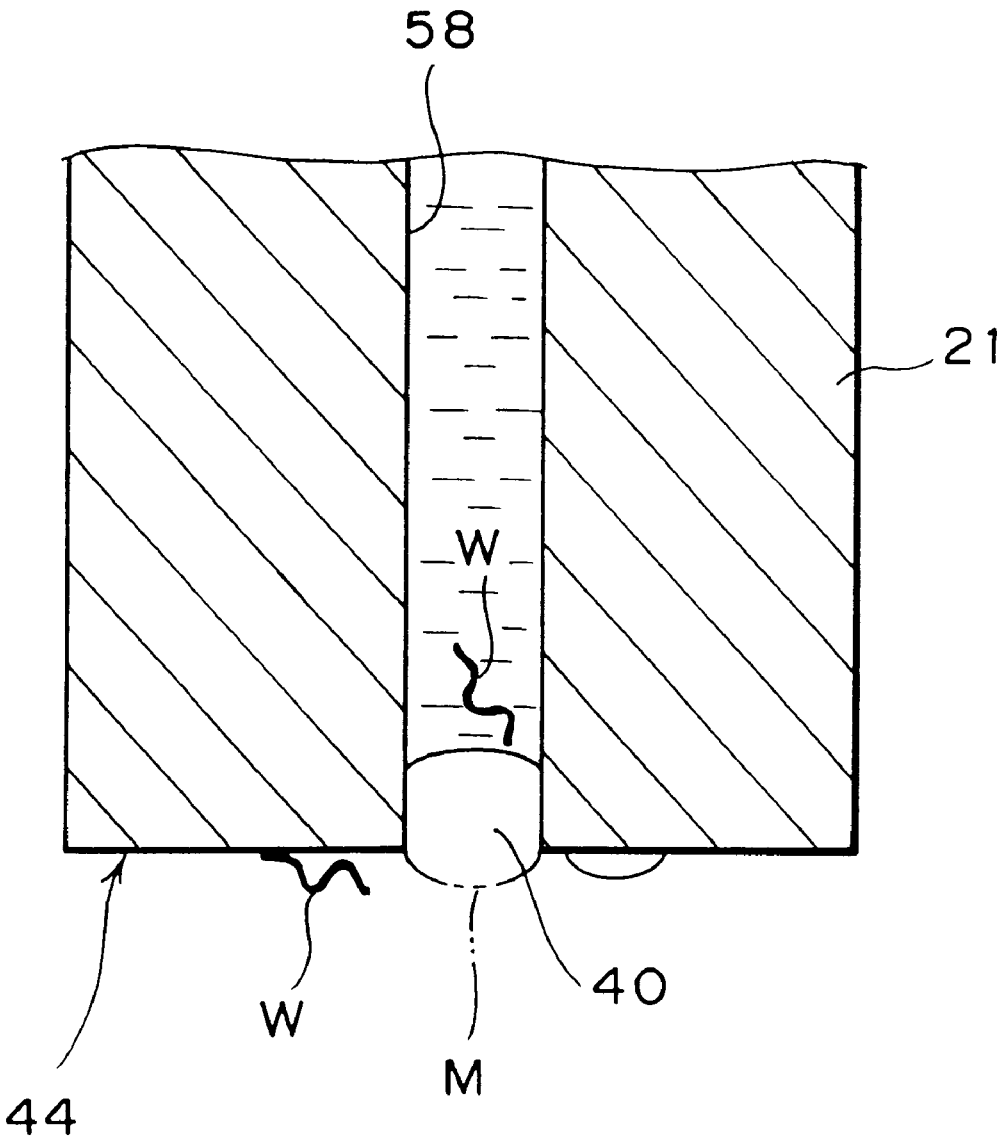
FIG. 11 is a section showing a construction of a tip end portion of the ink-jet head.

When the ink-jet head 21 is moved from the condition shown in FIG. 8 in the capping position to the wiping position to the wiping position shown in FIG. 9, a negative pressure corresponding to a waterhead difference H acts in the ink passage 58 of the ink-jet head 21. Thus, the position of the ink surface (ink meniscus) formed at the ejection opening 40 of the ink-jet head 21 is retracted into the ink passage 58 (see FIGS. 4 and 11) in the conventional apparatus, and associated therewith, the foreign matter W, such as dust and the like and the ink deposited in the vicinity of the ejection opening 30 are drawn into the ink passage 58. Such negative pressure is similarly generated in the case where the ink-jet head 21 is moved from the image forming position to the recovery process position.

However, in the shown embodiment, when the ink-jet head 21 located at the image forming position is moved to the recovery process position or when the ink-jet head 21 located at the capping position is elevated to the wiping position, the position of the ink surface or ink meniscus M formed in the ejection opening 40 of the ink-jet head 21 is not drawn into the ink passage 58 (see FIGS. 4 and 11) by preventing flow of the ink by blocking the ink supply tube 32 and the ink circulating tube 39 to prevent suction of the foreign matter, such as dust and the like and the ink deposited in the vicinity of the ejection opening 40.

In the foregoing embodiment, the cut-sheet 20 is employed as the printing medium, but any material and kind of the printing medium may be applicable adapting to the mode of the image forming apparatus to be an object. For example, the printing medium can be a perforated continuous paper which can be cut at the perforation, a sheet in a form of roll, on which labels on strippable paper are sequentially arranged, film, cloth and so on.

The present invention achieves distinct effects when applied to an ink-jet apparatus which has means for generating thermal energy such as electrothermal transducers or laser light, and which causes changes in ink by the thermal energy so as to eject ink. This is because such a system can achieve a high density and high resolution image.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid, and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the ink-jet head; and third, bubbles are grown in liquid corresponding to the drive signals. By using the growth and collapse of the bubbles, the ink is expelled from at least one of the ink ejection openings of the ink-jet head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better image forming.

U.S. Pat. Nos. 4,558,333 and 4,459,600 disclose the following structure of an ink-jet head, which is incorporated into the present invention: this structure includes heating portions disposed on bent portions in addition to a combination of the ejection openings, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection openings of the electrothermal transducers, and the latter discloses a structure in which openings for absorbing pressure waves caused by thermal energy are formed corresponding to the ejection openings. Thus, irrespective of the type of the ink-jet head, the present invention can achieve image forming positively and effectively.

It is further preferable to add a preliminary auxiliary system for the ink-jet head as a constituent of the image forming apparatus because they serve to make the effect of the present invention more reliable. Examples of the preliminary auxiliary system are a preliminary heating means utilizing electrothermal transducers or a combination of other heater elements and the electrothermal transducers.

The number and type of ink-jet heads to be mounted on the image forming apparatus can be also changed. For example, only one ink-jet head corresponding to a single-color ink, or a plurality of ink-jet heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, it is also effective to eject treatment liquid (printing ability enhancing liquid) for adjusting printing ability of the ink depending upon the printing medium.

Furthermore, although the above-described embodiments use liquid ink, inks that are liquid when the recording signal is applied can be used: for example, inks can be employed that solidify at a temperature lower than the room temperature and are softened or liquefied at the room temperature. The present invention is most effective when it uses the film boiling phenomenon to expel the ink.

Furthermore, the image forming apparatus of the present invention can be employed not only as an image output terminal of an information processing device such as a computer, but also as an output device of a copying machine including a reader, and as an output device of a facsimile or textile printing apparatus having a transmission and receiving function. The printing medium may be sheet form or elongated paper or cloth, or plate form, wood, stone, resin, glass, metal, and in addition, a three-dimensional structural member and so on.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An image forming method for forming an image on a printing medium in an image forming position utilizing a liquid ejection head for forming the image on the printing medium by ejecting liquid while in the image forming position, comprising:

a step of performing a recovery process at a recovery process position above the image forming position for recovering an ejecting condition of the liquid from the liquid ejecting head; and a step of closing a liquid supply passage for supplying the liquid to the liquid ejection head during movement of the liquid ejection head from the image forming position to the recovery process position.

2. An image forming method as claimed in claim 1, wherein the recovery process position includes a capping position for covering an ejection opening surface provided with an ejection opening of the liquid ejection head for ejecting the liquid, and a wiping position above the capping position for wiping the ejection opening surface.

3. An image forming method as claimed in claim 2, wherein the recovery process includes at least one of steps of performing preliminary ejection of the liquid from the ejection opening of the liquid ejection head at the capping position, expelling the liquid from the ejection opening of the liquid ejection head by pressurizing the liquid supply passage, and circulating the liquid through the liquid ejection head.

4. An image forming method as claimed in claim 1, wherein the liquid is ink or a treatment liquid for adjusting printing ability of the ink on and/or in the printing medium.

5. An image forming method as claimed in claim 1, wherein the liquid is pressure-supplied from the liquid supply passage to the liquid ejection head in a state of closing the liquid supply passage.

6. An apparatus for forming an image on a printing medium utilizing a liquid ejection head provided with an section opening for ejecting liquid, comprising:

a liquid supply passage connected to the liquid ejection head;

recovery process means for recovering an ejecting condition of the liquid from the liquid ejection head at a recovery process position;

head moving means for moving the liquid ejection head between the recovery process position for performing a recovery process of the liquid ejection head by said recovery process means and an image forming position for forming an image on the printing medium by the liquid ejection head;

closing means for closing said liquid supply passage; and controlling means for controlling said head moving means to move the liquid ejection head and for controlling said closing means to close said liquid supply passage during movement of the liquid ejection head at least to the recovery process position.

7. An image forming apparatus as claimed in claim 6, wherein the recovery process position includes a capping position and a wiping position located above the capping position, said recovery process means comprising a capping member for covering an ejection opening surface provided with the ejection opening of the liquid ejection head for ejecting the liquid at the capping position and a wiping member for wiping the ejection opening surface at the wiping position.

8. An image forming apparatus as claimed in claim 7, wherein said recovery process means receives preliminarily ejected liquid from the ejection opening of the liquid ejection head at the capping position, expels the liquid from the ejection opening of the liquid ejection head by actuating the liquid supply means or circulates the liquid through the liquid ejection head.

9. An image forming apparatus as claimed in claim 6, wherein said liquid ejection head comprises an ejection energy generating portion for generating energy for ejecting the liquid from said ejection opening.

10. An image forming apparatus as claimed in claim 9, wherein said ejection energy generating portion comprises an electrothermal transducer for generating thermal energy.

11. An image forming apparatus as claimed in claim 10, wherein a plurality of said ejection openings are provided for said liquid ejection head and are arranged over the entire width of a printing region of the printing medium.

12. An image forming apparatus as claimed in claim 6, wherein the liquid is pressure-supplied from said liquid supply passage to the liquid ejection head in a state of closing said liquid supply passage.

* * * * *

UNITED STATES PATENT AND TRADEMARK OFFICE

CERTIFICATE OF CORRECTION

PATENT NO. : 6,491,365 B2 
DATED : December 10, 2002
INVENTOR(S) : Sonobe

It is certified that error appears in the above-identified patent and that said Letters Patent is hereby corrected as shown below:

Title page,
Item [73], Assignee, "Canon Aptex," should read -- Canon Aptex Inc., --.
Item [56], References Cited, FOREIGN PATENT DOCUMENTS, "01281947" should read -- 1-281947 --.

Column 1,
Line 55, "one-half" should read -- one half --; and
Line 67, "electrostaticly" should read -- electrostatically --.

Column 8,
Line 53, "form" should read -- from --.

Column 12,
Line 3, "section" should read -- ejection --; and
Line 42, "claim 10," should read -- claim 6, --.

Signed and Sealed this

Thirtieth Day of September, 2003

JAMES E. ROGAN
*Director of the United States Patent and Trademark Office*